United States Patent [19]

Matuska

[11] 4,231,401

[45] Nov. 4, 1980

[54] FABRIC FOR PAPERMAKING MACHINES

[75] Inventor: Tibor L. Matuska, Pensacola, Fla.

[73] Assignee: Unaform, Inc., Shreveport, La.

[21] Appl. No.: 916,125

[22] Filed: Jun. 16, 1978

[51] Int. Cl.[2] ..... D03D 15/00

[52] U.S. Cl. ..... 139/383 A; 139/425 A; 162/DIG. 1

[58] Field of Search ..... 139/383 R, 383 A, 420 R, 139/420 A, 425 R, 425 A, 426 R; 162/348, DIG. 1; 428/259, 377

[56] References Cited

U.S. PATENT DOCUMENTS

| | | | |
|---|---|---|---|
| 1,103,943 | 7/1914 | Coups | 139/425 A |
| 2,740,434 | 4/1956 | Lemieux | 139/383 R |
| 2,792,851 | 5/1957 | Moeckel | 139/383 R |
| 2,903,021 | 9/1959 | Holden et al. | 139/383 R |
| 2,925,832 | 2/1960 | Bowser | 139/383 R |
| 3,060,547 | 10/1962 | MacBeau | 139/383 A |
| 3,224,923 | 12/1965 | Hindle et al. | 139/383 A |

FOREIGN PATENT DOCUMENTS

| | | | |
|---|---|---|---|
| 1011897 | 4/1952 | France | 139/383 A |

*Primary Examiner*—Henry Jaudon
*Attorney, Agent, or Firm*—Fleit & Jacobson

[57] ABSTRACT

A Fourdrinier or forming fabric in which a plurality of warp yarns and a first plurality of weft yarns are woven according to a first weave pattern containing a predetermined sequence of shedding and picking instructions, and the plurality of warp yarns and a second plurality of weft yarns are woven according to a second weave pattern containing a predetermined sequence of shedding and picking instructions, the first pattern being different from the second pattern.

26 Claims, 18 Drawing Figures

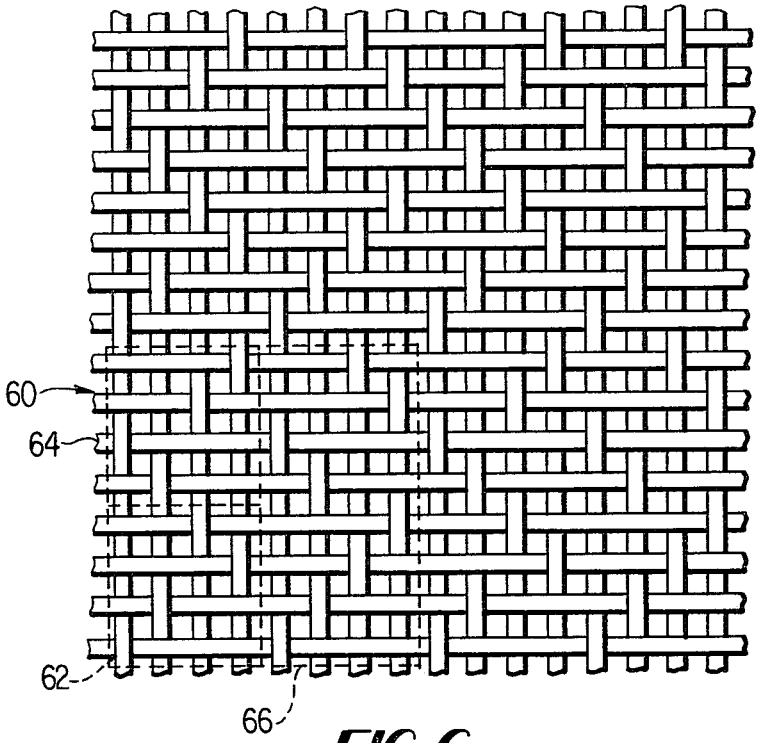
FIG. 6
FIG. 7
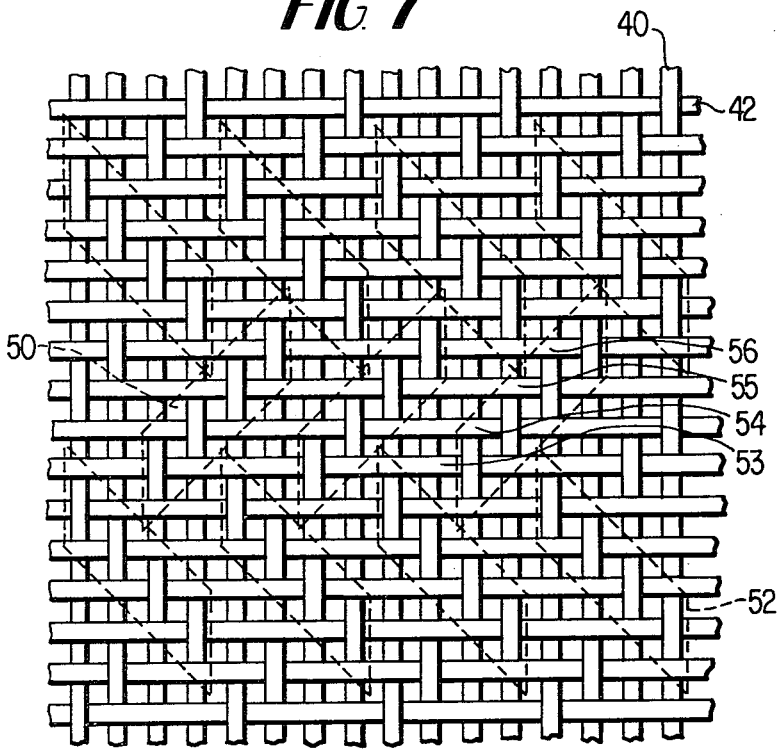

FABRIC FOR PAPERMAKING MACHINES

BACKGROUND OF THE INVENTION

1. Field of the Invention

This invention relates to woven forming fabrics for papermaking machines.

2. Description of the Prior Art

In a Fourdrinier papermaking machine, paper stock, also called "furnish" or "stuff", is fed onto the top or outer surface of a travelling endless belt, which serves as the papermaking surface of the machine. The bottom or inner surface of the endless belt is supported on and driven by rolls associated with the machine. Fourdrinier belts, also known as Fourdrinier wires, forming media or forming fabrics, are commonly formed from a length of woven fabric with its ends joined together in a seam to provide an endless belt. Forming fabrics of this type generally comprise a plurality of spaced longitudinal warp threads and a plurality of spaced transverse weft threads which have been woven together on a suitable loom.

Initially, forming fabrics were woven wire structures made from materials such as phosphor bronze, bronze, stainless steel, brass or suitable combinations thereof. Recently in the papermaking field, it has been found that synthetic materials may be used in whole or in part to produce forming fabrics of superior quality. Nylon, a polyamide fiber, has been found to be suitable. Other examples of suitable materials are polyesters, such as Dacron, or acrylic fibers such as Orlon, dynel and Acrilan, or copolymers, such as saran. The warp and weft yarns of the forming fabric may be of the same or different constituent materials and/or constructions, and may be in the form of monofilament or multifilament yarns.

A very common weave used in making forming fabrics is referred to as the "four-harness satin" or "three-by-one-broken-twill". In this weave the warp yarns each pass over one and under three weft yarns to make a broken twill pattern of relatively short knuckles across the cloth.

One of the major problems caused by certain twill and satin weaves is a phenomenon called "pairing", which will be explained in detail hereinafter. Suffice it to say at this point, pairing is the misalignment of adjacent warp or weft yarns caused when two floats are in close proximity within a weave pattern. A float is a portion of a weft yarn that passes over two or more warp yarns or a portion of a warp yarn that passes over two or more weft yarns before interweaving. Pairing in a forming fabric results in drainage holes of varying sizes and affects overall drainage during the papermaking process. In addition, loose furnish fibers may penetrate through larger holes and build up on machine rolls. Further, the inconsistency of hole size in the forming fabric affects the overall smoothness of the paper produced during the papermaking process.

Since paper manufacturing machines are among the most delicately adjusted pieces of machinery used in any industry there is a great need to find a solution to the pairing problem. The subject invention provides that solution.

SUMMARY OF THE INVENTION

The subject invention relates to an improved weave pattern for forming fabrics used in papermaking machines. In particular, the inventive forming fabric comprises a plurality of warp yarns and a first plurality of weft yarns woven according to a first weave pattern containing a predetermined sequence of shedding and picking instructions, and the plurality of warp yarns and a second plurality of weft yarns woven according to a second weave pattern containing a predetermined sequence of shedding and picking instructions, the first pattern being different from the second pattern.

It is an object of the subject invention to provide a forming fabric which maximizes the overall smoothness of the paper produced.

It is another object of the present invention to produce a forming fabric having uniform drainage apertures throughout.

It is a further object of the present invention to eliminate the phenomenon of pairing associated with prior art forming fabrics.

It is still another object of the present invention to produce a forming fabric in which warp and weft yarns of a first round of weave are interwoven with warp and weft yarns of a second round of weave, the first round of weave being different from the second round of weave.

It is yet another object of the present invention to provide a method of weaving a forming fabric in which pairing is minimized.

Still a further object of the present invention is to provide a method of weaving a forming fabric by alternating weave patterns throughout the weave.

Additional objects of the present invention will become apparent from a reading of the appended specification and claims in which preferred but not necessarily the only forms of the invention will be described in detail, taken in connection with the drawings accompanying and forming a part of the application.

IN THE DRAWINGS

FIG. 6 is a fragmentary plan view of still another fabric weave embodying the subject invention.

FIG. 7 is a enlarged fragmentary plan view of the fabric of FIG. 3.

DESCRIPTION OF THE PREFERRED EMBODIMENTS

Figure 1:
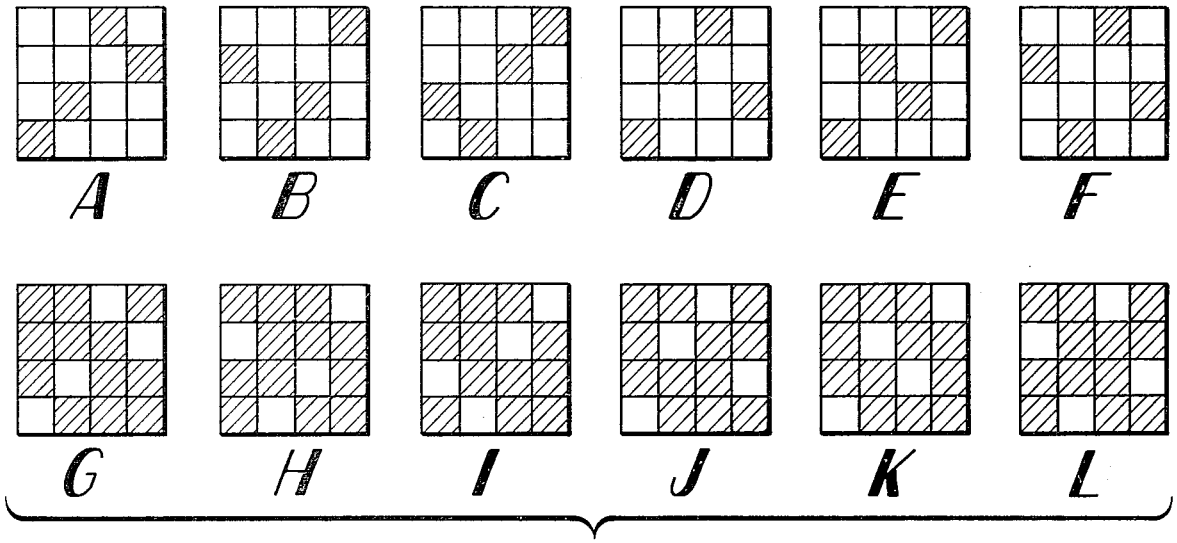
FIGS. 1A through 1L are examples of weave patterns used to generate rounds of weave.

In describing the preferred embodiments of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

The technical design of a weave is called a weave pattern. FIGS. 1A–1L illustrate some weave patterns. A weave pattern is drawn on a squared paper, on which the vertical lines of squares represent warp yarns, while the horizontal lines represent weft yarns. A filled-in square indicates that the warp yarn it represents is above the weft, whereas a blank means weft above warp. Every pattern repeats itself. The area comprising the minimum number of warp and weft intersections constituting the pattern is called a "round of weave".

In weaving a fabric, warp yarns are raised and lowered in a predetermined sequence, determined by the weave pattern, so that they form a "shed" or passage for weft yarns. The formation of the passage is referred to in the art as "shedding". Inserting a weft yarn between the divided warp yarns is called "picking".

A weave pattern is read from left to right and from bottom to top. Thus the weave pattern of FIG. 1A contains the following sequence of shedding and picking instructions:

shedding instruction No. 1—lower all warp yarns except the first which is raised
picking instruction No. 1—pick first weft yarn
shedding instruction No. 2—lower all warp yarns except the second which is raised
picking instruction No. 2—pick second weft yarn
shedding instruction No. 3—lower all warp yarns except the fourth which is raised
picking instruction No. 3—pick third weft yarn
shedding instruction No. 4—lower all warp yarns except the third which is raised
picking instruction No. 4—pick fourth weft yarn It is to be understood that the sequence of shedding and picking instructions will yield a round of weave. When a fabric is woven, the round of weave is repeated over and over a sufficient number of times to yield a fabric of desired width and desired length. It should be noted at this point that the weave patterns illustrated in FIGS. 1A–1L are presented as examples of three-by-one broken twills, or four-harness satin weave patterns used to generate prior art forming fabrics. They are not intended to limit the scope of the subject invention since there are literally hundreds of forming fabric weave patterns known in the prior art. Rather, they are presented to show how the subject invention may be used to eliminate the phenomenon of pairing which occurs in many of the prior art fabrics.

Figure 2:
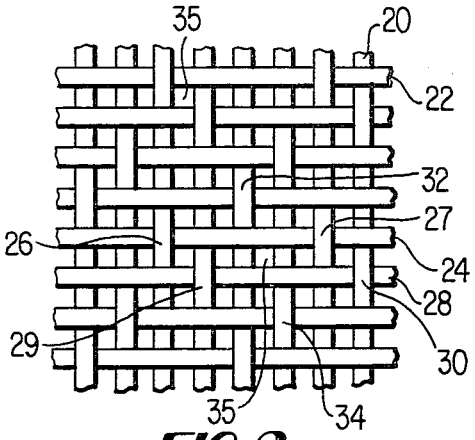
FIG. 2 PRIOR ART
FIG. 2 is a fragmentary plan view of a prior art weave showing the phenomenon of pairing.

The phenomenon of pairing will be described with reference to FIG. 2, which illustrates the top surface of a four-harness satin forming fabric. The fabric is woven on a suitable loom by interweaving a plurality of warp yarns 20 with a plurality of weft yarns 22. Weft yarn 24 is held in place by knuckles 26 and 27 and is adjacent to knuckles 29 and 32. Weft yarn 28 is held in place by knuckles 29 and 30 and is adjacent to knuckles 27 and 34. As can be seen, each of weft yarns 24 and 28 has three warp yarns below it. This condition, as explained previously, is referred to in the art as float. In FIG. 2 weft yarns 24 and 28 each illustrate a three-float. These floats are in the cross-machine direction. If the fabric is turned over, it will be seen that floats are also produced in the machine direction. If the fabric was manufactured using a weave pattern as shown in FIGS. 1E–1H the top floats would be in the machine direction and the bottom floats would be in the cross-machine direction. It should be noted at this point, that if a forming fabric is produced by an endless weaving process or a flat weaving process, the designations used herein for warp and weft yarns will be reversed.

It has been noticed that after the stretching and heat seting operation used to manufacture a forming fabric as well as after the handling of such a fabric, yarns situated within the fabric in a manner similar to those of yarns 24 and 28, exhibit the phenomenon of pairing. Sometimes, pairing can be seen even during the weaving operation. That is, two adjacent three-float yarns such as 24 and 28 undergo "shoving" in the machine direction. This shoving, or relative movement of yarns, causes these yarns to move toward each other as shown in FIG. 2. As can be seen, any two adjacent three-float yarns will exhibit the phenomenon of pairing. As a result of pairing, drain apertures 35 of varying sizes are formed to provide a forming fabric having the shortcomings mentioned hereinbefore.

The subject invention provides a weaving technique which results in weave patterns which are not plagued by the phenomenon of pairing. Such a fabric is illustrated in FIG. 3, and is formed by interweaving warp yarns 40 with weft yarns 42 in a manner described hereinafter.

Figure 3:
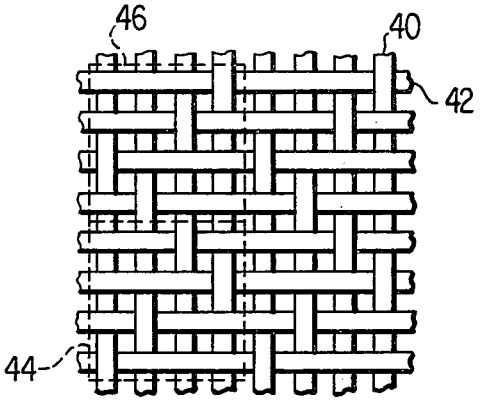
FIG. 3 is a fragmentary plan view of a fabric weave embodying the subject invention.

In the preferred embodiment, the fabric of FIG. 3 is generated on a four harness loom. It should be noted, however, that looms of various sizes made be used to practice the invention.

There are thirty-two possible weave patterns for generating forming fabrics similar to the prior art fabric shown in FIG. 2. Sixteen of these fabrics contain top floats in the cross-machine direction and bottom floats in the machine direction. The remaining sixteen fabrics contain top floats in the machine direction and bottom floats in the cross-machine direction. In all cases, there are floats in the machine direction and there are floats in the cross-machine direction; and these floats exhibit pairing in both directions. The degree of pairing depends on the relative thickness, tenacity and tension applied during the fabrication process.

It has been found that by selectively combining these weave patterns, new and improved fabrics may be generated which retain the advantages of a particular weave pattern while eliminating pairing, a disadvantage associated with the weave pattern.

With reference to FIG. 3, a preferred embodiment of an improved forming fabric is generated in the following manner. The predetermined sequence of shedding and picking instructions provided by the weave pattern of FIG. 1A are carried out to create the first round of weave 44. Then, the predetermined sequence of shedding and picking instructions provided by the weave pattern of FIG. 1C are carried out to create the second round of weave 46. The sequences of shedding and picking instructions for the two weave patterns are alternatively carried out until a fabric of desired length is formed.

Figure 4:
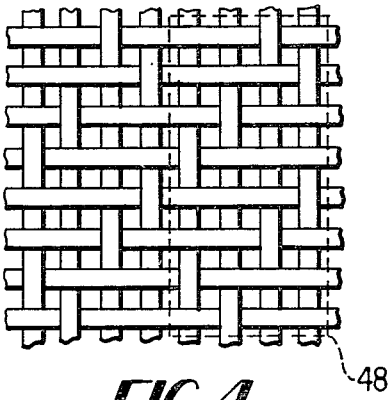
FIG. 4 is a fragmentary plan view of another fabric weave embodying the subject invention.
Figure 5:
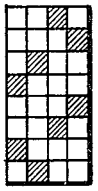
FIG. 5 is a diagram of the weave pattern used to generate a preferred forming fabric.

With reference to FIG. 4, another preferred embodiment of an improved forming fabric is generated in the following manner. The shedding and picking instructions of the weave pattern of FIG. 1B are alternately combined with the shedding and picking instructions of the weave pattern of FIG. 1D to yield the round of weave 48 and the resultant weave pattern shown in FIG. 5. The resultant weave pattern is carried out until a fabric of desired length is formed.

Yet another preferred embodiment of an improved forming fabric is illustrated in FIG. 6. A round of weave 60 is generated by combining in the following manner the weave patterns shown in FIGS. 1A, 1C, 1E, and 1F. An eight harness loom is employed. The predetermined sequence of shedding and picking instructions provided by the weave pattern of FIG. 1A are carried out on the first four harnesses to create a sub-round of weave 62. Then, the predetermined sequence of shedding and picking instructions provided by the weave pattern of FIG. 1C are carried out on the first four harnesses to create a sub-round of weave 64. The shedding and picking instructions of the weave pattern of FIG. 1E are alternately combined on the remaining four harnesses with the shedding and picking instructions of the weave pattern of FIG. 1F to yield the sub-round of weave 66.

FIG. 7, is an enlarged fragmentary plan view of the fabric weave of FIG. 3. The improved fabric contains a series of left-hand twills 50 four knuckles long in the cross machine direction and a series of right-hand twills 52 four knuckles long in the cross machine direction, the twill groups 50 and 52 alternating in the machine direction. If the fabric weave is generated using the weave patterns of FIGS. 1G–1L the twill groups will be in the machine direction and alternate in the cross machine direction.

Groups of floating weft yarns are contained throughout the fabric. For example, a group of three-float weft yarns is illustrated by weft yarns 53–56. It has been found that by weaving the forming fabric as explained hereinbefore, the weft yarns 53–56 do not exhibit the phenomenon of pairing after the weaving, stretching and heat setting operations used to manufacture the fabric. Pairing is also eliminated in the warp yarns.

The foregoing description of the weaving process has, for the most part, concentrated on the flat weave and the forming fabric which is woven flat and which then has its ends seamed together to develop an endless belt. It should be appreciated however, that the present invention is not limited to the flat weave. Rather, it is contemplated that the selective combination of weaving patterns also be used in the endless weaving of forming fabrics. In this regard, the weaving process is somewhat different.

In the endless weaving of a forming fabric, the warp and weft yarns are reversed in the machine sense from the flat weaving process. That is, where the warp yarns in a flat-woven fabric are used in the machine direction, it is the weft yarns which form the machine direction yarns in an endless-woven fabric. For in endless weaving, the weft yarns loop around to form a continuous belt, alternating between the upper and lower surfaces of the fabric during the weaving process. After weaving, however, with the exception of the seam, a flat-woven fabric and an endless-woven fabric of the same design will be virtually identical.

Because of the different weaving styles, the flat weaving process and the endless weaving process carry different shedding and picking instructions, even if the two fabrics are to be of the same weave. Typical shedding and picking instructions for the flat weave are set forth above. For the endless weaving process, the first shedding and the first picking instructions would be the same; this would for example, effect the upper surface of the endless belt. Then, however, the next shedding instruction would be reversed from the first. That is, if the first shedding instruction were to lower all warp yarns except the first which is raised, the second shedding instruction would be to lower the first warp yarns and raise the rest. This second shedding instruction would effect the lower surface of the endless belt. Then, what would be the second shedding instruction for a flat weave, would be the third instruction for an endless weave; this third instruction would then be reversed for the fourth instruction, etc. Still, as described above with reference to a flat weave, the weave patterns can be selectively combined so as to eliminate significant pairing complications in the endless-woven forming fabric.

Obviously many modifications and variations of the present invention are possible in light of the above teachings. For example, a first weave pattern containing a predetermined sequence of shedding and picking instructions may be combined according to the subject invention with a second weave pattern containing a different number of shedding and picking instructions. It is contemplated that the present invention include weaving a fabric whose weave pattern is developed by alternating weaving instructions of, for example, a $2\times1$ twill and a $3\times1$ broken twill. It is of course appropriate to weave such a weave with a loom having more harnesses. It is therefore to be understood that within the scope of the appended claims, the invention may be practiced otherwise than as specifically described.

What is claimed is:

1. A planar forming fabric comprising at least one single layer fabric having first and second surfaces, a plurality of rounds of weave arranged to each other to define the width of said single layer fabric, said adjacently arranged rounds of weave repeated a desired number of times to define the length of said single layer fabric, each of said rounds of weave being defined by warp and weft yarns interwoven according to shedding and picking instructions determined by at least two different coplanar weave patterns, said adjacent rounds of weave comprising a plurality of cross-machine direction floats in close proximity to each other on said first surface, a plurality of machine direction knuckles on said first surface, a plurality of machine direction floats in close proximity to each other on said second surface, a plurality of cross-machine direction knuckles on said second surface, said knuckles and floats coacting to prevent misalignment of said floats that are in close proximity to each other, and to provide uniform drainage apertures on said fabric.

2. The forming fabric of claim 1, wherein said fabric is woven flat and is then seamed.

3. The forming fabric of claim 1 wherein said fabric is woven endless.

4. The forming fabric of claim 1, wherein each of said rounds of weave comprises first through fourth adjacent warp yarns and first through eighth adjacent weft yarns, said first warp yarn being above said first and sixth weft yarns, said second warp yarns being above said second and fifth weft yarns, said third warp yarn being above said fourth and seventh weft yarns and said fourth warp yarn being above said third and eighth weft yarns.

5. The forming fabric of claim 1 wherein each of said rounds of weave comprises first through fourth adjacent warp yarns and first through eighth adjacent weft yarns, said first warp yarn being above said second and fifth weft yarns, said second warp yarn being above said first and sixth weft yarns, said third warp yarn being above said third and eighth weft yarns and said fourth warp yarn being above said fourth and seventh weft yarns.

6. The forming fabric of claim 1, wherein each of said rounds of weave comprises first through fourth adjacent weft yarns and first through eighth adjacent warp yarns, said first weft yarn being above said first and sixth warp yarns, said second weft yarns being above said second and fifth warp yarns, said third weft yarn being above said fourth and seventh warp yarns and said fourth weft yarns being above said third and eighth warp yarns.

7. The forming fabric of claim 1, wherein each of said rounds of weave comprises first through fourth adjacent weft yarns and first through eighth adjacent warp yarns, said first weft yarn being above said second and fifth warp yarns, said second weft yarn being above said first and sixth warp yarns, said third weft yarn being above said third and eighth warp yarns and said fourth weft yarn being above said fourth and seventh warp yarns.

8. The forming fabric of claim 1, wherein said at least two different weave patterns comprises first and second different weave patterns.

9. The forming fabric of claim 8, wherein said at least two different weave patterns further comprises third and fourth different weave patterns.

10. The forming fabric of claim 9, wherein said first, second, third, and fourth weave patterns are all different.

11. The forming fabric of claim 8, wherein each of said rounds of weave are defined by said warp and weft yarns interwoven by alternately carrying out the shedding instructions of said first weave pattern and said second weave pattern.

12. The forming fabric of claim 8, wherein each of said rounds of weave are defined by said warp and weft yarns interwoven by first carrying out the shedding and picking instructions of said first weave pattern and then the shedding and picking instructions of said second weave pattern.

13. The forming fabric according to claim 8, wherein the number of shedding and picking instructions in the first and second weave patterns are the same.

14. The forming fabric according to claim 8, wherein the number of picking and shedding instructions in said first and second weave patterns are different.

15. The forming fabric according to claim 1, wherein said warp and weft yarns are monofilament yarns.

16. The forming fabric according to claim 1, wherein said warp and weft yarns are of a synthetic material.

17. The forming fabric according to claim 1, wherein said warp and weft yarns are multifilament yarns.

18. A method for producing a planar forming fabric having first and second surfaces, said method comprising the steps of:

weaving at least one single layer fabric from a plurality of rounds of weave, each of said rounds of weave being defined by warp and weft yarns interwoven according to shedding and picking instructions determined by at least two different weave patterns, said weave patterns being coplanar and arranging said rounds of weave adjacent to each other to define the length and width of said single layer fabric and to provide a plurality of cross-machine direction floats in close proximity to each other on said first surface, a plurality of machine direction knuckles on said first surface, a plurality of machine direction floats in close proximity on said second surface, and a plurality of crossmachine direction knuckles on said second surface, wherein said knuckles and floats coact to prevent misalignment of said floats that are in close proximity to each other and to provide uniform drainage apertures on said fabric.

19. The method of claim 18, wherein the shedding and picking instructions of said weaving step are determined by first and second different weave patterns.

20. The method of claim 19, wherein the shedding and picking instructions of said weaving step are further determined by third and fourth different weave patterns.

21. The method of claim 20, wherein the four weave patterns are all different from each other.

22. The method according to claim 19, wherein the weaving step further comprises the step of alternately carrying out the shedding instructions of said first weave pattern with the shedding instructions of said second weave pattern.

23. The method according to claim 19, wherein the number of shedding and picking instructions in said first weave pattern is the same as the number of shedding and picking instructions in said second weave pattern.

24. The method according to claim 19, wherein the number of shedding and picking instructions in said first weave pattern is different from the number of shedding and picking instructions in said second weave pattern.

25. The method of claim 18, wherein said fabric is woven flat, and further comprising the step of joining the ends of said fabric to make the same endless.

26. The method of claim 18, wherein said fabric is woven endless.

* * * * *